US009575440B2

(12) United States Patent
Michishita et al.

(10) Patent No.: US 9,575,440 B2
(45) **Date of Patent: *Feb. 21, 2017**

(54) TRANSFER DEVICE, IMAGE FORMING APPARATUS

(71) Applicant: KYOCERA Document Solutions Inc., Osaka-shi, Osaka (JP)

(72) Inventors: Yasuhiro Michishita, Osaka (JP); Tetsuya Toichi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/914,602

(22) PCT Filed: May 22, 2015

(86) PCT No.: PCT/JP2015/064728

§ 371 (c)(1),
(2) Date: Feb. 25, 2016

(87) PCT Pub. No.: WO2016/002379

PCT Pub. Date: Jan. 7, 2016

(65) Prior Publication Data

US 2016/0209787 A1 Jul. 21, 2016

(30) Foreign Application Priority Data

Jun. 30, 2014 (JP) ..... 2014-133690

(51) Int. Cl.
*G03G 15/16* (2006.01)
*G03G 15/00* (2006.01)

(52) U.S. Cl.
CPC ..... *G03G 15/1675* (2013.01); *G03G 15/1685* (2013.01); *G03G 15/657* (2013.01);
(Continued)

(58) Field of Classification Search
CPC ..... G03G 15/1665–15/1685; G03G 15/657
See application file for complete search history.

(56) References Cited

U.S. PATENT DOCUMENTS 6,097,924 A * 8/2000 Okuyama ..... G03G 15/167 399/101
9,366,999 B2 * 6/2016 Michishita ..... G03G 15/1665

FOREIGN PATENT DOCUMENTS

JP H03186876 A 8/1991
JP H09134082 A 5/1997
(Continued)

OTHER PUBLICATIONS

ISA Japanese Patent Office, International Search Report Issued in Application No. PCT/JP2015/064728, Aug. 4, 2015, WIPO, 3 pages.

(Continued)

*Primary Examiner* — David Gray
*Assistant Examiner* — Carla Therrien
(74) *Attorney, Agent, or Firm* — Alleman Hall McCoy Russell & Tuttle LLP

(57) ABSTRACT

A transfer device includes a conveyance belt, a transfer roller, and a stretch roller. The conveyance belt is in contact with an image carrier that carries a toner image, and conveys a sheet via a contact position with the image carrier. A voltage having a polarity opposite to a charging polarity of toner that forms the toner image is applied to the transfer roller, and the transfer roller transfers the toner image carried by the image carrier onto the sheet at the contact position. The stretch roller stretches the conveyance belt at a separation position in which the sheet is separated from the conveyance belt and which is downstream of the contact position in a conveyance direction in which the sheet is conveyed by the conveyance belt, and the voltage having the (Continued)

polarity opposite to the charging polarity of the toner is applied to the stretch roller.

6 Claims, 5 Drawing Sheets

(52) U.S. Cl.
CPC ..... *G03G 15/168* (2013.01); *G03G 15/1665* (2013.01); *G03G 2215/00679* (2013.01); *G03G 2215/1623* (2013.01)

(56) References Cited

FOREIGN PATENT DOCUMENTS

| | | | |
|---|---|---|---|
| JP | 2002031960 | A | 1/2002 |
| JP | 2005148643 | A | 6/2005 |
| JP | 2007094343 | | 4/2007 |
| JP | 2007298768 | A | 11/2007 |

OTHER PUBLICATIONS

European Patent Office, Extended European Search Report Issued in Application No. 15815852.7, Jul. 18, 2016, Germany, 8 pages.

* cited by examiner

FIG. 5

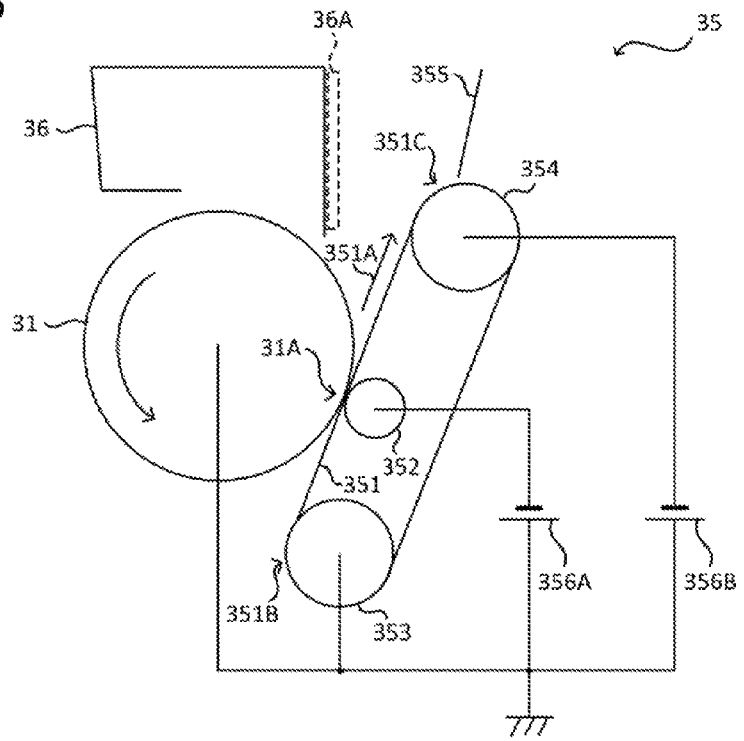

FIG. 6

| | STRUCTURE OF TRANSFER DEVICE 35 | | DEGREE OF CONTAMINATION ON COLLECTION MEMBER 36A | REDUCTION IN DENSITY OF CONDITIONING SHEET HAVING MOISTURE COMPONENT OF 8% | REDUCTION IN DENSITY OF CONDITIONING SHEET HAVING MOISTURE COMPONENT OF 10% |
|---|---|---|---|---|---|
| | SECOND ROLLER 354 | RESISTOR 357 | | | |
| EXAMPLE 1 | MADE OF ALUMINUM CONNECTED TO VOLTAGE APPLYING PORTION 356A | INSTALLED | ◎ | NOT FOUND | NOT FOUND |
| EXAMPLE 2 | MADE OF ALUMINUM CONNECTED TO VOLTAGE APPLYING PORTION 356A | NOT INSTALLED | ◎ | NOT FOUND | FOUND |
| EXAMPLE 3 | MADE OF ALUMINUM CONNECTED TO VOLTAGE APPLYING PORTION 356B | NOT INSTALLED | ◎ | NOT FOUND | NOT FOUND |
| COMPARATIVE EXAMPLE 1 | MADE OF ALUMINUM BEARING GROUNDED | NOT INSTALLED | × | NOT FOUND | NOT FOUND |

FIG. 9

| | STRUCTURE OF TRANSFER DEVICE 35 | | DEGREE OF CONTAMINATION ON COLLECTION MEMBER 36A | OCCURRENCE OF INFERIOR IMAGE |
|---|---|---|---|---|
| | SECOND ROLLER 354 | GUIDE MEMBER 355 | | |
| EXAMPLE 4 | MADE OF ALUMINUM CONNECTED TO VOLTAGE APPLYING PORTION 356A | CONDUCTIVE MATERIAL CONNECTED TO VOLTAGE APPLYING PORTION 356A | ◎ | NOT FOUND |
| EXAMPLE 5 | MADE OF ALUMINUM CONNECTED TO VOLTAGE APPLYING PORTION 356B | CONDUCTIVE MATERIAL CONNECTED TO VOLTAGE APPLYING PORTION 356B | ◎ | NOT FOUND |
| COMPARATIVE EXAMPLE 2 | MADE OF ALUMINUM BEARING GROUNDED | SURFACE RESISTANCE 1000Ω/cm$^2$ CONNECTED TO 100MΩ RESISTOR | × | FOUND |
| REFERENCE EXAMPLE 1 | MADE OF ALUMINUM CONNECTED TO VOLTAGE APPLYING PORTION 356A | SURFACE RESISTANCE 1000Ω/cm$^2$ CONNECTED TO 100MΩ RESISTOR | ◎ | FOUND |

TRANSFER DEVICE, IMAGE FORMING APPARATUS

TECHNICAL FIELD

The present invention relates to an image forming apparatus that forms an image according to electrophotography, and a transfer device included in the image forming apparatus.

BACKGROUND ART

Generally, in an image forming apparatus such as a printer capable of forming an image according to electrophotography, a structure has been known in which a toner image formed on an image carrier such as a photosensitive drum is transferred onto a sheet such as a print sheet that is conveyed while being electrostatically attracted to a conveyance belt (e.g., refer to Patent Literature 1). In the image forming apparatus of this type, since the sheet is electrostatically attracted to the conveyance belt, improvements in separability from the image carrier, conveyance stability, and transfer property are achieved.

CITATION LIST

Patent Literature

[PTL 1] Japanese Laid-Open Patent Publication No. 2002-31960

SUMMARY OF THE INVENTION

Problems to be Solved by the Invention

However, in the case where a sheet is conveyed while being electrostatically attracted to the conveyance belt, if a roller disposed at a position where the sheet is separated from the conveyance belt is grounded, separation discharge may occur when the sheet is separated from the conveyance belt, which may cause scattering of the toner adhered to the sheet.

An object of the present invention is to provide a transfer device and an image forming apparatus which are able to suppress occurrence of separation discharge when a sheet is separated from a conveyance belt, in the structure where the sheet is conveyed while being electrostatically attracted to the conveyance belt.

Solution to the Problems

A transfer device according to an aspect of the present invention includes a conveyance belt, a transfer roller, and a stretch roller. The conveyance belt is in contact with an image carrier that carries a toner image, and conveys a sheet via a contact position with the image carrier. A voltage having a polarity opposite to a charging polarity of toner that forms the toner image is applied to the transfer roller, and the transfer roller transfers the toner image carried by the image carrier onto the sheet at the contact position. The stretch roller stretches the conveyance belt at a separation position in which the sheet is separated from the conveyance belt and which is downstream of the contact position in a conveyance direction in which the sheet is conveyed by the conveyance belt, and the voltage having the polarity opposite to the charging polarity of the toner is applied to the stretch roller.

An image forming apparatus according to another aspect of the present invention includes the transfer device.

Advantageous Effects of the Invention

According to the present invention, a transfer device and an image forming apparatus are realized which are able to suppress occurrence of separation discharge when a sheet is separated from a conveyance belt, in a structure in which the sheet is conveyed while being electrostatically attracted to the conveyance belt.

BRIEF DESCRIPTION OF THE DRAWINGS

FIG. 5 is a diagram showing another example of the structure of the transfer device included in the image forming apparatus according to the first embodiment of the present invention.

FIG. 6 is a diagram showing results of an experiment using the image forming apparatus according to the first embodiment of the present invention.

FIG. 9 is a diagram showing results of an experiment using the image forming apparatus according to the second embodiment of the present invention.

DESCRIPTION OF EMBODIMENTS

Hereinafter, embodiments of the present invention will be described with reference to the accompanying drawings to enable understanding of the present invention. The embodiments described below each represent an exemplary implementation of the present invention, and the technical scope of the present invention is not limited by the embodiments described below.

[Schematic Structure of Image Forming Apparatus 10]

Figure 1:
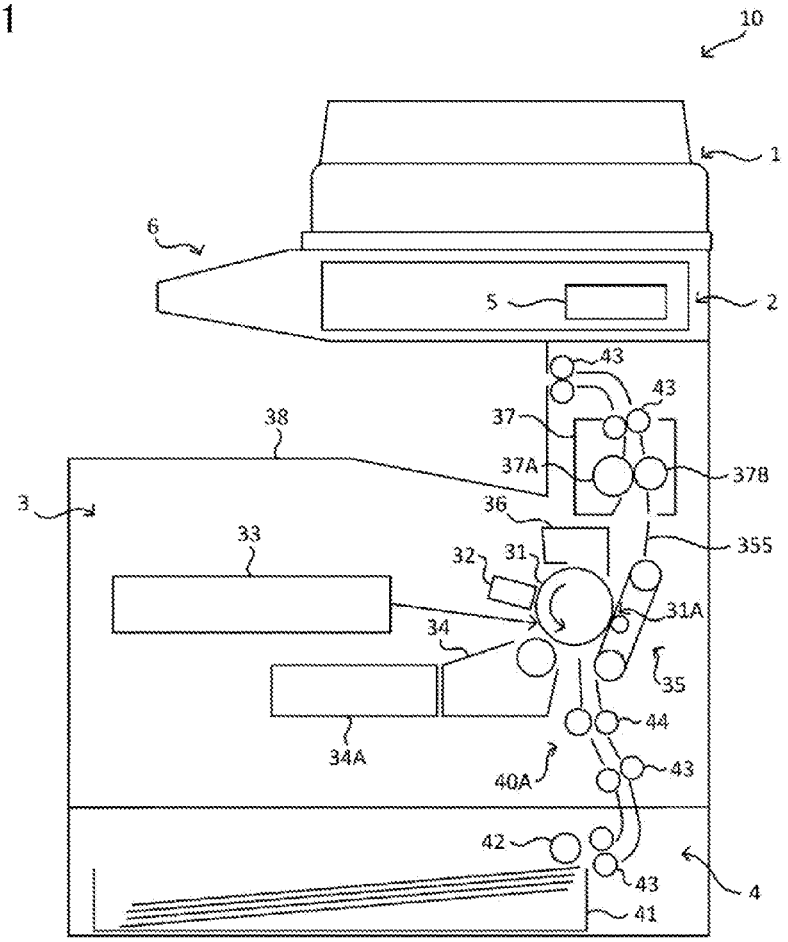
FIG. 1 is a diagram showing a structure of an image forming apparatus according to a first embodiment of the present invention.

First, a schematic structure of an image forming apparatus 10 according to an embodiment of the present invention will be described with reference to FIG. 1 and FIG. 2. FIG. 1 is a schematic cross-sectional view showing the structure of the image forming apparatus 10.

Figure 2:
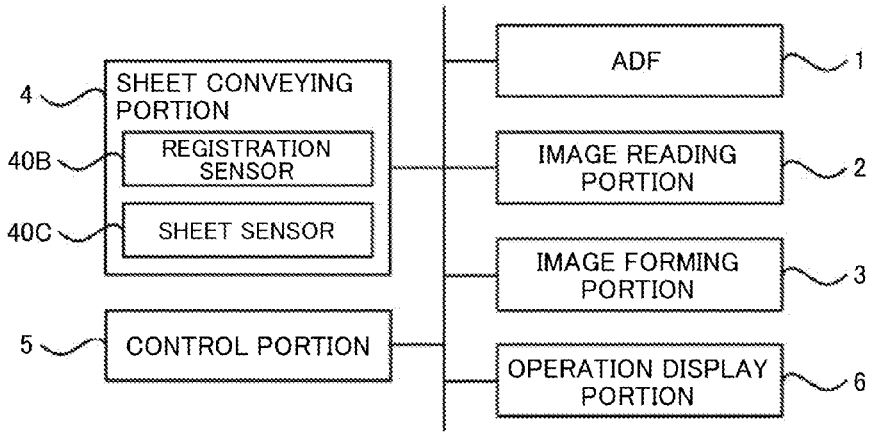
FIG. 2 is a block diagram showing a system structure of the image forming apparatus according to the first embodiment of the present invention.

As shown in FIG. 1 and FIG. 2, the image forming apparatus 10 includes an ADF 1, an image reading portion 2, an image forming portion 3, a sheet conveying portion 4, a control portion 5, and an operation display portion 6. The image forming apparatus 10 is a multifunction peripheral having a printer function of forming an image on the basis of image data, and having a plurality of functions such as a scan function, a facsimile function, or a copy function. The present invention is applicable to an image forming apparatus such as a printer device, a facsimile device, or a copy machine.

The ADF 1 is an automatic document feeder that includes a document set portion, multiple pairs of conveying rollers, a document holder, and a sheet discharge portion which are not shown, and conveys a document to be read by the image reading portion 2. The image reading portion 2 includes a document table, a reading unit, multiple mirrors, an optical lens, and a CCD (Charge Coupled Device) which are not shown, and reads image data from the document. The control portion 5 includes control devices such as a CPU, a ROM, a RAM, and an EEPROM which are not shown, and controls the operation of the image forming apparatus 10. The operation display portion 6 includes a display portion such as a liquid crystal display that displays various information according to a control instruction from the control portion 5, and an operation portion such as an operation key or a touch panel that allows input, to the control portion 5, of various information according to an operation performed by a user.

The image forming portion 3 is able to execute an image forming process (print process) of forming an image according to electrophotography on the basis of the image data read by the image reading portion 2. In addition, the image forming portion 3 is also able to execute the image forming process on the basis of image data inputted from an external information process apparatus such as a personal computer.

Specifically, as shown in FIG. 1, the image forming portion 3 includes a photosensitive drum 31, a charging device 32, a laser scanning unit (LSU) 33, a developing device 34, a transfer device 35, a cleaning device 36, a fixing device 37, and a sheet discharge tray 38. In the image forming portion 3, an image is formed on a sheet fed from the sheet conveying portion 4 by the following procedure, and the sheet on which the image is formed is discharged to the sheet discharge tray 38. The sheet is a sheet material such as paper, coated paper, a postcard, an envelope, and an OHP sheet.

First, the photosensitive drum 31 is uniformly charged at a predetermined potential by the charging device 32. Next, the surface of the photosensitive drum 31 is irradiated with light based on the image data by the LSU 33. Thus, an electrostatic latent image corresponding to the image data is formed on the surface of the photosensitive drum 31. Then, the electrostatic latent image on the photosensitive drum 31 is developed (visualized) as a toner image by the developing device 34. The photosensitive drum 31 is an example of an image carrier of the present invention. Toner (developer) is supplied to the developing device 34 from a toner container 34A that is attachable to and detachable from the image forming portion 3. Further, in the image forming apparatus 10, the toner is agitated together with a carrier in the developing device 34, whereby the toner is charged through friction so as to have a positive polarity, for example.

Subsequently, the toner image formed on the photosensitive drum 31 is transferred onto the sheet by the transfer device 35. Specifically, the toner image is transferred onto the sheet at a contact position 31A in which the photosensitive drum 31 contacts a conveyance belt 351 (refer to FIG. 3) of the transfer device 35. The transfer device 35 will be described later in detail. Thereafter, when the sheet passes between a fixing roller 37A and a pressure roller 37B of the fixing device 37, the toner image transferred onto the sheet is melted and fixed by being heated by the fixing roller 37A. The toner remaining on the surface of the photosensitive drum 31 is removed by the cleaning device 36.

The sheet conveying portion 4 conveys the sheet on which an image is to be formed by the image forming portion 3. Specifically, as shown in FIG. 1, the sheet conveying portion 4 includes a sheet feed cassette 41, a pickup roller 42, multiple pairs of conveying rollers 43, and a pair of registration rollers 44. The pickup roller 42, the conveying roller pairs 43, and the registration roller pair 44 are rotated with a driving force generated by a motor (not shown) and transmitted thereto, thereby conveying the sheet.

The sheet feed cassette 41 is attachable to and detachable from a housing of the image forming apparatus 10, and contains the sheet on which an image is to be formed by the image forming portion 3. The sheet contained in the sheet feed cassette 41 is lifted by a lift plate (not shown) provided on a bottom portion of the sheet feed cassette 41, up to a contact position with the pickup roller 42 provided above the sheet feed cassette 41. Then, the uppermost sheet that contacts the pickup roller 42 is fed to a conveying path 40A by the pickup roller 42, and conveyed through the conveying path 40A by the conveying roller pairs 43.

The registration roller pair 44 feeds the sheet to the contact position 31A at a predetermined timing, in accordance with arrival of the toner image formed on the photosensitive drum 31 at the contact position 31A. Specifically, a registration sensor 40B (refer to FIG. 2) that detects presence/absence of the sheet is provided upstream of the registration roller pair 44 in the sheet conveyance direction of the conveying path 40A. The registration sensor 40B is a transmission type or reflection type optical sensor, for example. When an electric signal indicating detection of the sheet is outputted from the registration sensor 40B, the control portion 5 determines the above-mentioned timing on the basis of the distance from the position where the sheet is detected to the contact position 31A, the conveying speed of the sheet, and the like. Then, the control portion 5 controls an electromagnetic clutch (not shown) capable of switching between presence and absence of the driving force transmitted from the motor to the registration roller pair 44, thereby to cause the registration roller pair 44 to rotate and feed the sheet at the above-mentioned timing. Thus, the sheet is fed to the contact position 31A in accordance with arrival of the toner image formed on the photosensitive drum 31 at the contact position 31A.

Then, the sheet which has passed through the contact position 31A and on which the toner image has been transferred, passes between the fixing roller 37A and the pressure roller 37B in the fixing device 37, whereby the toner image is melted and fixed. Thereafter, the sheet is conveyed to the sheet discharge tray 38 by the conveying roller pairs 43, and discharged.

Then, in the image forming apparatus 10, occurrence of a jam (paper jam) in the conveying path 40A is detected. Specifically, the conveying path 40A is provided with, in addition to the registration sensor 40B, a plurality of sheet sensors 40C (refer to FIG. 2) that detect presence/absence of the sheet. The control portion 5 detects occurrence of a jam, in the case where a signal indicating detection of the sheet has not been outputted from the registration sensor 40B or the sheet sensors 40C by the time a predetermined time has elapsed since conveyance of the sheet has started, for example. The sheet sensors 40C are reflection type or transmission type optical sensors, for example.

By the way, in the image forming apparatus 10, the sheet is conveyed while being electrostatically attracted to the conveyance belt 351. Thus, improvements in the separability of the sheet from the photosensitive drum 31, the conveyance stability of the sheet, and the transfer property of the toner image onto the sheet are achieved.

However, in the case where the sheet is conveyed while being electrostatically attracted to the conveyance belt 351, if the roller disposed at a position where the sheet is separated from the conveyance belt 351 is grounded, separation discharge may occur when the sheet is separated from the conveyance belt 351, which may cause scattering of the toner adhered to the sheet. On the other hand, in the image forming apparatus 10, it is possible to suppress occurrence of separation discharge when the sheet is separated from the conveyance belt 351, as described below.

First Embodiment

Figure 3:
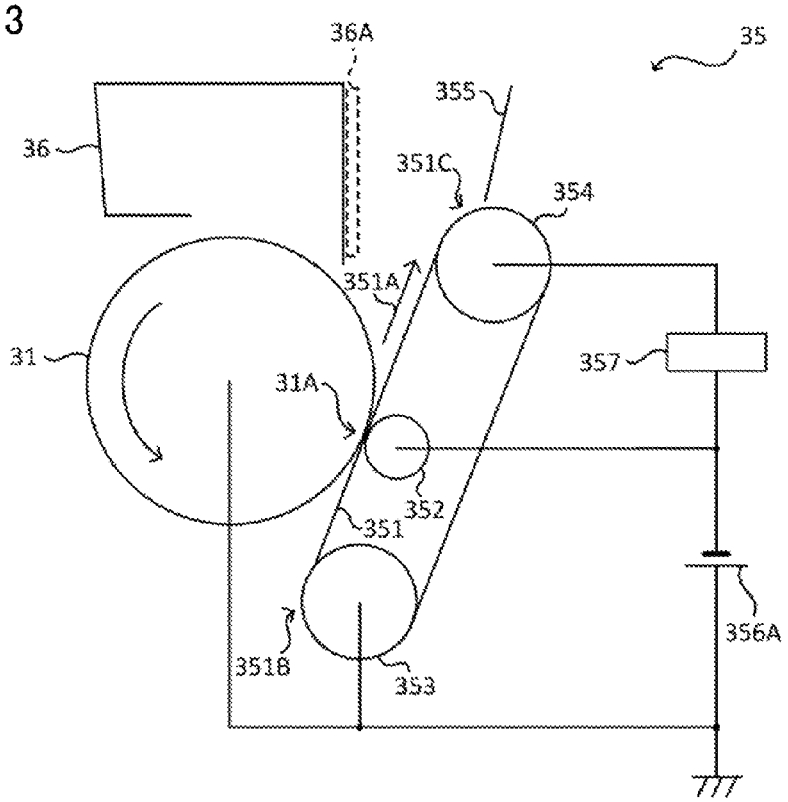
FIG. 3 is a diagram showing a structure of a transfer device included in the image forming apparatus according to the first embodiment of the present invention.
Figure 4:
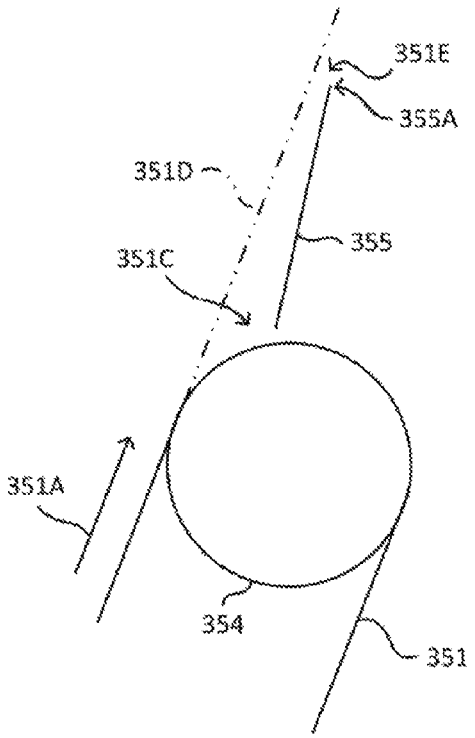
FIG. 4 is a diagram showing a structure of a part, near a separation position, of the image forming apparatus according to the first embodiment of the present invention.

Hereinafter, the transfer device 35 will be described with reference to FIG. 3 to FIG. 5. FIGS. 3 and 5 are schematic cross-sectional views each showing an example of the structure of the transfer device 35. FIG. 4 is a schematic cross-sectional view showing the structure near a separation position 351C. In FIG. 4, an alternate long and two short dashes line indicates a movement route 351D of the sheet separated from the conveyance belt 351.

The transfer device 35 conveys the sheet fed from the registration roller pair 44 so that the sheet is electrostatically attracted to the conveyance belt 351, and transfers the toner image formed on the photosensitive drum 31 onto the sheet at the contact position 31A. Specifically, as shown in FIG. 3, the transfer device 35 includes the conveyance belt 351, a transfer roller 352, a first roller 353, a second roller 354, a guide member 355, a voltage applying portion 356A, and a resistor 357.

The conveyance belt 351 comes in contact with the photosensitive drum 31, and conveys the sheet via the contact position 31A. Specifically, as shown in FIG. 3, the conveyance belt 351 is an endless belt member stretched on and between the first roller 353 and the second roller 354 with a predetermined tension. For example, the conveyance belt 351 is formed by coating an outer circumferential surface of a belt-shaped rubber member with a fluorine-based resin. The outer circumferential surface of the conveyance belt 351 moves along a conveyance direction 351A when the first roller 353 or the second roller 354 is rotationally driven by a motor (not shown). Thus, the conveyance belt 351 is able to convey the sheet from a conveyance start position 351B to the separation position 351C via the contact position 31A.

A voltage having a polarity opposite to the charging polarity of the toner that forms the toner image is applied to the transfer roller 352, whereby the transfer roller 352 transfers the toner image carried on the photosensitive drum 31 onto the sheet at the contact position 31A. Specifically, as shown in FIG. 3, the transfer roller 352 is in contact with an inner circumferential surface of the conveyance belt 351 at the contact position 31A. Then, a voltage having a negative polarity is applied from the voltage applying portion 356A to the transfer roller 352, whereby the transfer roller 352 causes electric discharge between itself and the conveyance belt 351 at the contact position 31A, and injects negative polarity charges to the conveyance belt 351. Thus, the toner image formed on the photosensitive drum 31 is attracted to the conveyance belt 351 and transferred onto the sheet. Further, the charges injected to the conveyance belt 351 cause the sheet conveyed by the conveyance belt 351 to be electrostatically attracted to the outer circumferential surface of the conveyance belt 351.

As shown in FIG. 3, the first roller 353 stretches the conveyance belt 351 at the conveyance start position 351B where conveyance of the sheet is started and which is upstream of the contact position 31A in the conveyance direction 351A of the conveyance belt 351. For example, the first roller 353 is formed of a conductive member such as a metal, and is provided in the transfer device 35 so as to be grounded via a bearing. Therefore, part of the charges injected to the conveyance belt 351 is removed by the first roller 353.

As shown in FIG. 3, the second roller 354 stretches the conveyance belt 351 at the separation position 351C where the sheet is separated from the conveyance belt 351 and which is downstream of the contact position 31A in the conveyance direction 351A of the conveyance belt 351. The second roller 354 is an example of a stretch roller of the present invention.

In the case where the second roller 354 is grounded, when the sheet electrostatically attracted to the outer circumferential surface of the conveyance belt 351 is separated from the conveyance belt 351 at the separation position 351C, separation discharge occurs between the sheet and the conveyance belt 351. Specifically, on the basis of the positional relationship between the material of the sheet and the material of the conveyance belt 351 in the known triboelectric series, exchange of charges is performed between the sheet and the conveyance belt 351. For example, when the material of the sheet is paper and the outer circumferential surface of the conveyance belt 351 is formed of a fluorine-based resin such as PTFE, the sheet discharges negative polarity charges and is charged to the positive polarity when being separated from the conveyance belt 351, while the conveyance belt 351 receives the charges discharged from the sheet and is charged to the negative polarity. In this case, the electrostatic adhesion force, to the sheet, of the positive polarity toner adhered to the sheet is reduced, which may cause scattering of the toner from the sheet.

On the other hand, in the image forming apparatus 10, a voltage having a polarity opposite to the charging polarity of the toner is applied to the second roller 354. Specifically, a voltage having a negative polarity is applied from the voltage applying portion 356A to the second roller 354. Thus, movement of the negative polarity charges from the sheet to the conveyance belt 351, i.e., occurrence of separation discharge, is suppressed.

The guide member 355 guides, to the fixing device 37, the sheet separated from the conveyance belt 351 at the separation position 351C. Specifically, as shown in FIG. 4, the guide member 355 is provided at a position opposed to the sheet being conveyed from the second roller 354 to the fixing device 37 along the movement route 351D. Thus, a front end portion of the sheet in the conveyance direction 351A hangs down in the vertical downward direction by its own weight, whereby the movement of the sheet is restricted so as not to deviate from the movement route 351D. Further, in the image forming apparatus 10, the guide member 355 is arranged in a predetermined orientation with respect to the movement route 351D, whereby the motion of the sheet separating from the conveyance belt 351 due to self-stripping is supported. For example, the guide member 355 is arranged so that an angle formed between a straight line extending from the axis of the second roller 354 to the contact point with the second roller 354 in the movement route 351D, and a straight line extending from the axis of the second roller 354 toward a rear end portion of the guide member 355 in the conveyance direction 351A, is within a range not smaller than 30 degrees but not larger than 60 degrees.

The voltage applying portion 356A applies a voltage having a polarity opposite to the charging polarity of the toner to the transfer roller 352 and the second roller 354. The voltage applying portion 356A that applies the voltage to the transfer roller 352 and the second roller 354 is an example of a first voltage applying portion of the present invention.

Specifically, the voltage applying portion 356A is a power supply connected to the transfer roller 352 and the second roller 354 as shown in FIG. 3. The voltage applying portion 356A is controlled by the control portion 5 and applies a voltage of a negative polarity to the transfer roller 352 and the second roller 354. For example, the control portion 5 controls the voltage applying portion 356A so that a current of −100 μA in total flows to the transfer roller 352 and the second roller 354. Thus, it is possible to implement the present invention without separately preparing a power supply that applies a voltage to the second roller 354.

In the case where the voltage applying portion 356A applies a voltage only while the sheet passes the contact position 31A, no voltage is applied to the second roller 354 while a rear end portion of the sheet in the conveyance direction 351A moves from the contact position 31A to the separation position 351C. Therefore, occurrence of separation discharge is not suppressed for a part of the sheet. In the image forming apparatus 10, a voltage is applied to the transfer roller 352 and the second roller 354 during a period from when the front end portion of the sheet in the conveyance direction 351A arrives at the contact position 31A to when the rear end portion of the sheet in the conveyance direction 351A separates from the separation position 351C.

Specifically, the control portion 5 obtains the arrival timing of the front end portion of the sheet to the contact position 31A and the separation timing of the rear end portion of the sheet from the separation position 351C, on the basis of an electric signal indicating detection of the front end portion of the sheet and an electric signal indicating detection of the rear end portion of the sheet which are outputted from the registration sensor 40B. Then, on the basis of the arrival timing and the separation timing, the control portion 5 causes the voltage applying portion 356A to apply the voltage during the period from when the front end portion of the sheet arrives at the contact position 31A to when the rear end portion of the sheet separates from the separation position 351C. Thus, it is possible to suppress occurrence of separation discharge over the entirety of the sheet.

Further, when the voltage applying portion 356A applies the voltage to the transfer roller 352 and the second roller 354, an excessive current may flow from the second roller 354 to the fixing device 37 via the sheet. In this case, the amount of current flowing from the transfer roller 352 to the photosensitive drum 31 becomes insufficient, which may cause a reduction in the density of the toner image transferred onto the sheet. Particularly when the degree of moisture in the sheet is high, an excessive current is more likely to flow from the second roller 354 to the fixing device 37 via the sheet. Therefore, in the image forming apparatus 10, as shown in FIG. 3, the resistor 357 is disposed on an energizing path between the voltage applying portion 356A and the second roller 354.

Specifically, the resistor 357 has a higher resistance value than the energizing path including the transfer roller 352, the conveyance belt 351, and the photosensitive drum 31. For example, the resistance value of the resistor 357 is 100 MΩ. Thus, flow of an excessive current from the second roller 354 to the fixing device 37 via the sheet is suppressed.

By the way, in the image forming apparatus 10, a power supply that applies a voltage to the second roller 354 may be provided independently of the voltage applying portion 356A that applies a voltage to the transfer roller 352. Specifically, a structure as shown in FIG. 5 is conceivable in which the transfer device 35 includes a voltage applying portion 356A that applies, to the transfer roller 352, a voltage having a polarity opposite to the charging polarity of the toner, and a voltage applying portion 356B that applies, to the second roller 354, a voltage having a polarity opposite to the charging polarity of the toner. The voltage applying portion 356A that applies a voltage to the transfer roller 352 is an example of a second voltage applying portion of the present invention. In addition, the voltage applying portion 356B that applies a voltage to the second roller 354 is an example of a third voltage applying portion of the present invention.

For example, the control portion 5 controls the voltage applying portion 356A so that a current of −100 μA flows to the transfer roller 352, and controls the voltage applying portion 356B so that a current of −15 μA flows to the second roller 354. In the case where the voltage applying portion 356B that applies a voltage to the second roller 354 is provided independently of the voltage applying portion 356A that applies a voltage to the transfer roller 352, it is possible to separate the control of the voltage applied to the second roller 354 from the control of the voltage applied to the transfer roller 352.

Examples 1 to 3

An experiment to examine the scattering state of the toner at the separation position 351C and the state of change in the print density was performed, with the structure of the transfer device 35 of the image forming apparatus 10 being varied. The results of the experiment are shown in FIG. 6. In the experiment, examination for the scattering state of the toner was performed according to the following method. That is, a collection member 36A (refer to FIG. 3) was provided on an outer side surface, opposing the separation position 351C, of the cleaning device 36, and the degree of contamination of the collection member 36A was confirmed after the image forming apparatus 10 was caused to execute, by 10,000 times, the print process of printing image data for experiment with a coverage rate of 50%. In the experiment, examination for the state of change in the print density was performed by a method of executing the print process by 10,000 times for each of two types of conditioning sheets, and confirming presence/absence of change in the density of each printed image. In FIG. 6, a double-circle indicates that contamination due to the toner was not confirmed on the collection member 36A. A cross indicates that contamination due to the toner confirmed on the collection member 36A exceeded a predetermined allowable range.

According to the experimental results shown in FIG. 6, when a voltage is applied to the second roller 354 (Examples 1 to 3), scattering of the toner at the separation position 351C is suppressed as compared to the case (Comparative Example 1) where the second roller 354 is in the grounded state. This seems to be resulted from that occurrence of separation discharge between the sheet and the conveyance belt 351 is suppressed at the separation position 351C.

Further, according to the experimental results shown in FIG. 6, in the case where the resistor 357 is not provided in the structure where the transfer roller 352 and the second roller 354 are connected to the voltage applying portion 356A (Example 2), a reduction in the print density is recognized in the conditioning sheet having a moisture content of 10%. This seems to be caused by that an excessive current flows from the second roller 354 to the fixing device 37 via the sheet and thereby the amount of current flowing from the transfer roller 352 to the photosensitive drum 31 becomes insufficient, which results in a reduction in the density of the toner image transferred onto the sheet.

Thus, in the image forming apparatus 10, since a voltage having a polarity opposite to the charging polarity of the toner is applied to the second roller 354, it is possible to suppress occurrence of separation discharge when the sheet is separated from the conveyance belt 351.

Second Embodiment

By the way, when the electrostatic adhesion force of the toner to the sheet is weak, the toner adhered to the sheet may scatter by the time the sheet is conveyed to the fixing device 37. Further, a phenomenon called electrostatic offset may occur in which the toner on the sheet is not fixed to the sheet but electrostatically adheres to the fixing roller 37A in the fixing device 37, and causes inferior image on the subsequent sheets.

Figure 7:
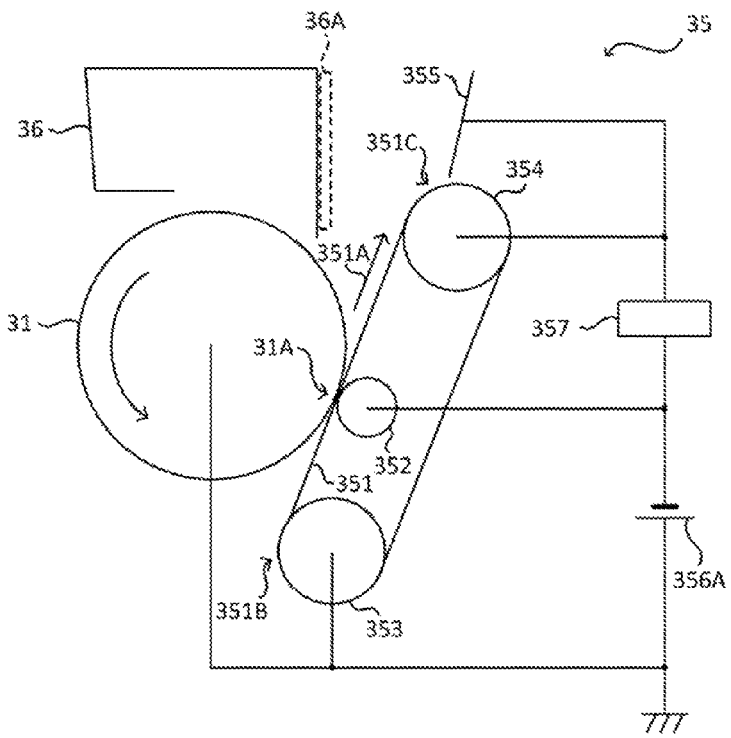
FIG. 7 is a diagram showing an example of a structure of a transfer device included in an image forming apparatus according to a second embodiment of the present invention.
Figure 8:
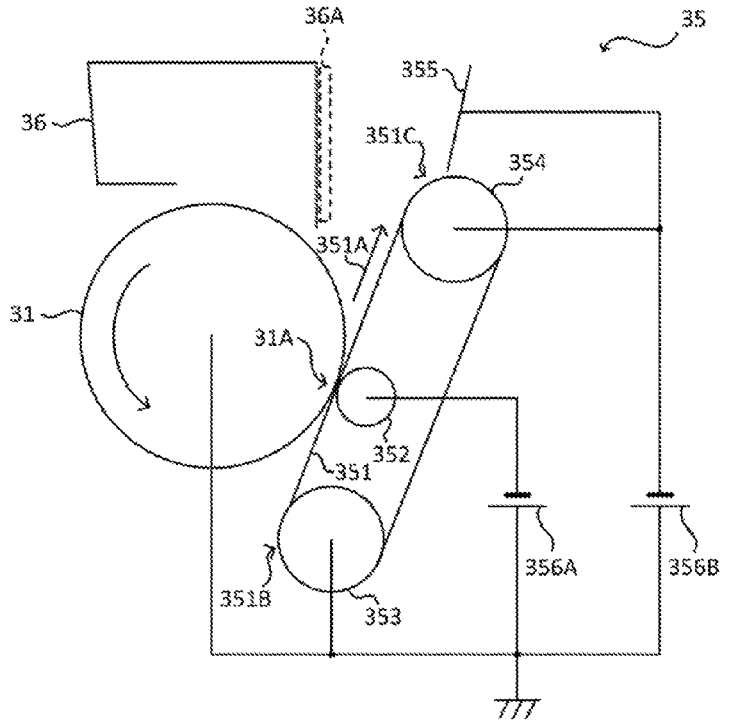
FIG. 8 is a diagram showing another example of the structure of the transfer device included in the image forming apparatus according to the second embodiment of the present invention.

Hereinafter, an image forming apparatus 10 according to a second embodiment of the present invention will be described with reference to FIG. 4, FIG. 7, and FIG. 8. FIG. 7 and FIG. 8 are schematic cross-sectional views each showing an example of a structure of a transfer device 35 included in the image forming apparatus 10 according to the second embodiment. Description of components common to those of the image forming apparatus 10 according to the first embodiment is not given.

As shown in FIG. 7, the image forming apparatus 10 according to the second embodiment is different from the image forming apparatus 10 according to the first embodiment in that the guide member 355 of the transfer device 35 is connected to the voltage applying portion 356A via a resistor 357.

That is, in the image forming apparatus 10 according to the second embodiment, a voltage having a polarity opposite to the charging polarity of the toner is applied to the guide member 355. Specifically, the guide member 355 is formed of a conductive member, and a voltage of a negative polarity is applied from the voltage applying portion 356A to the guide member 355. Thus, discharge is generated between the guide member 355 and the sheet that is conveyed from the second roller 354 toward the fixing device 37 along the movement route 351D, which enables injection of charges of the negative polarity to the sheet. Therefore, it is possible to improve the electrostatic adhesion force of the toner to the sheet.

More specifically, as shown in FIG. 4, the guide member 355 is disposed with a gap 351E of a predetermined width between a front end portion 355A thereof and the sheet that is conveyed along the movement route 351D. The width of the gap 351E is appropriately set on the basis of the known Paschen's law so that discharge occurs between the front end portion 355A of the guide member 355 and the sheet. For example, in the image forming apparatus 10 according to the second embodiment, the gap 351E is set to 1 mm.

Further, the guide member 355 is disposed at a position opposed to a surface of the sheet on the second roller 354 side. Therefore, as compared to the structure in which the guide member 355 is disposed at a position opposed to a surface of the sheet on which the toner image is formed, influence of the discharge between the guide member 355 and the sheet on the toner image formed on the sheet is suppressed.

In the case where the voltage applying portion 356A applies a voltage only while the sheet passes the contact position 31A, no voltage is applied to the guide member 355 while the rear end portion of the sheet in the conveyance direction 351A moves from the contact position 31A to the front end portion 355A of the guide member 355. Therefore, no discharge occurs between a part of the sheet and the guide member 355. Considering this, in the image forming apparatus 10 of the second embodiment, the voltage applying portion 356A applies a voltage to the transfer roller 352, the second roller 354, and the guide member 355 during a period from when the front end portion of the sheet in the conveyance direction 351A arrives at the contact position 31A to when the rear end portion of the sheet in the conveyance direction 351A separates from the front end portion 355A of the guide member 355.

Specifically, the control portion 5 obtains the arrival timing of the front end portion of the sheet to the contact position 31A and the separation timing of the rear end portion of the sheet from the front end portion 355A, on the basis of an electric signal indicating detection of the front end portion of the sheet and an electric signal indicating detection of the rear end portion of the sheet which are outputted from the registration sensor 40B. Then, on the basis of the arrival timing and the separation timing, the control portion 5 causes the voltage applying portion 356A to apply a voltage during the period from when the front end portion of the sheet arrives at the contact position 31A to when the rear end portion of the sheet separates from the front end portion 355A. Thus, it is possible to generate discharge between the entirety of the sheet and the guide member 355.

Further, when the voltage applying portion 356A applies the voltage to the transfer roller 352, the second roller 354, and the guide member 355, an excessive current may flow from the second roller 354 or the guide member 355 to the fixing device 37 via the sheet. In this case, the amount of current flowing from the transfer roller 352 to the photosensitive drum 31 becomes insufficient, which may cause a reduction in the density of the toner image transferred onto the sheet. Particularly, when the moisture content of the sheet is high, an excessive current is more likely to flow from the second roller 354 or the guide member 355 to the fixing device 37 via the sheet. Therefore, in the image forming apparatus 10 according to the second embodiment, as shown in FIG. 7, the second roller 354 and the guide member 355 are connected to the voltage applying portion 356A via a common energizing path, and the resistor 357 is disposed on the common energizing path. Thus, flow of an excessive current from the second roller 354 or the guide member 355 to the fixing device 37 via the sheet is suppressed.

By the way, in the image forming apparatus 10 according to the second embodiment, a power supply that applies a voltage to the second roller 354 and the guide member 355 may be provided independently of the voltage applying portion 356A that applies a voltage to the transfer roller 352. Specifically, a structure as shown in FIG. 8 is conceivable in which the transfer device 35 includes a voltage applying portion 356A that applies, to the transfer roller 352, a voltage having a polarity opposite to the charging polarity of the toner, and a voltage applying portion 356B that applies, to the second roller 354 and the guide member 355, a voltage having a polarity opposite to the charging polarity of the toner.

For example, the control portion 5 controls the voltage applying portion 356A so that a current of −100 μA flows to the transfer roller 352, and controls the voltage applying portion 356B so that a current of −15 μA in total flows to the second roller 354 and the guide member 355. In the case where the voltage applying portion 356B that applies a voltage to the second roller 354 and the guide member 355 is provided independently of the voltage applying portion 356A that applies a voltage to the transfer roller 352, it is possible to separate the control of the voltage applied to the second roller 354 and the guide member 355 from the control of the voltage applied to the transfer roller 352.

Examples 4 and 5

An experiment to examine the scattering state of the toner at the separation position 351C and the generation state of inferior image was performed, with the structure of the transfer device 35 being varied in the image forming apparatus 10 according to the second embodiment. The results of the experiment are shown in FIG. 9. The method of examining the scattering state of the toner in the experiment is identical to that of the experiment for the image forming apparatus 10 according to the first embodiment. In the experiment, the examination for the generation state of inferior image was performed by a method of confirming presence/absence of generation of inferior image during execution of the print process by 10,000 times.

According to the experimental results shown in FIG. 9, when a voltage is applied to the second roller 354 (refer to Examples 4 and 5, and Reference Example 1), scattering of the toner at the separation position 351C is suppressed as compared to the case (Comparative Example 2) where the second roller 354 is in the grounded state. This seems to be resulted from that occurrence of separation discharge between the sheet and the conveyance belt 351 is suppressed at the separation position 351C.

Further, according to the experimental results shown in FIG. 9, in the case where a voltage is applied to the guide member 355 (Examples 4 and 5), generation of inferior image is suppressed as compared to the case where no voltage is applied to the guide member 355. This seems to be resulted from that negative polarity charges are injected to the sheet due to discharge generated between the guide member 355 and the sheet, and thereby the electrostatic adhesion force of the toner to the sheet is increased.

The invention claimed is:

1. A transfer device comprising:

a conveyance belt being in contact with an image carrier that carries a toner image, and configured to convey a sheet via a contact position with the image carrier;

a transfer roller to which a voltage having a polarity opposite to a charging polarity of toner that forms the toner image is applied, the transfer roller being configured to transfer the toner image carried by the image carrier onto the sheet at the contact position;

a stretch roller to which the voltage having the polarity opposite to the charging polarity of the toner is applied, the stretch roller being configured to stretch the conveyance belt at a separation position in which the sheet is separated from the conveyance belt, the separation position being downstream of the contact position in a conveyance direction in which the sheet is conveyed by the conveyance belt; and a guide member to which the voltage having the polarity opposite to the charging polarity of the toner is applied, the guide member being formed of a conductive member and provided at a position opposed to the sheet being conveyed from the stretch roller to a fixing device that fixes, to the sheet, the toner image that has been transferred to the sheet by the transfer roller.

2. The transfer device according to claim 1 further comprising a first voltage applying portion configured to apply the voltage having the polarity opposite to the charging polarity of the toner, to the transfer roller, the stretch roller, and the guide member.

3. The transfer device according to claim 1 wherein the stretch roller and the guide member are connected to a first voltage applying portion via a resistor.

4. The transfer device according to claim 1 further comprising:

a second voltage applying portion configured to apply the voltage having the polarity opposite to the charging polarity of the toner, to the transfer roller; and a third voltage applying portion configured to apply the voltage having the polarity opposite to the charging polarity of the toner, to the guide member.

5. The transfer device according to claim 4 further comprising:

a controller configured to control the second voltage applying portion and the third voltage applying portion so that a current flowing to the stretch roller and the guide member is smaller than a current flowing to the transfer roller.

6. An image forming apparatus including the transfer device according to claim 1.

* * * * *